United States Patent [19]

Bonassi

[11] 4,261,549

[45] Apr. 14, 1981

[54] TWO-SPEED WINCH

[75] Inventor: Luciano Bonassi, Saronno, Italy

[73] Assignee: Construzioni Barbarossa, Lomazzo, Italy

[21] Appl. No.: 916,242

[22] Filed: Jun. 16, 1978

[30] Foreign Application Priority Data

Jul. 22, 1977 [IT] Italy ..... 26017 A/77

[51] Int. Cl.[3] ..... B66D 1/30

[52] U.S. Cl. ..... 254/297; 74/810; 254/344

[58] Field of Search ..... 254/150 R; 74/810, 812, 74/112; 192/17 R

[56] References Cited

U.S. PATENT DOCUMENTS

| | | | |
|---|---|---|---|
| 3,656,596 | 4/1972 | Morgan | 192/17 R |
| 3,712,155 | 1/1973 | Stommel et al. | 254/150 R |
| 3,962,935 | 6/1976 | Hutton et al. | 254/150 R |
| 4,054,266 | 10/1977 | Guangorena | 254/150 R |

*Primary Examiner*—Robert J. Spar
*Assistant Examiner*—Kenneth Noland
*Attorney, Agent, or Firm*—Michael J. Striker

[57] ABSTRACT

A two-speed winch, particularly for nautical applications, comprises a stationary base, a hollow rotary drum supported on the base and a direction-reversible rotary shaft on the base and extending into the drum. The rotary drum may be driven by a first gear train at a first ratio, or by a second gear train at a different second ratio, in dependence upon the direction of rotation of the shaft.

12 Claims, 1 Drawing Figure

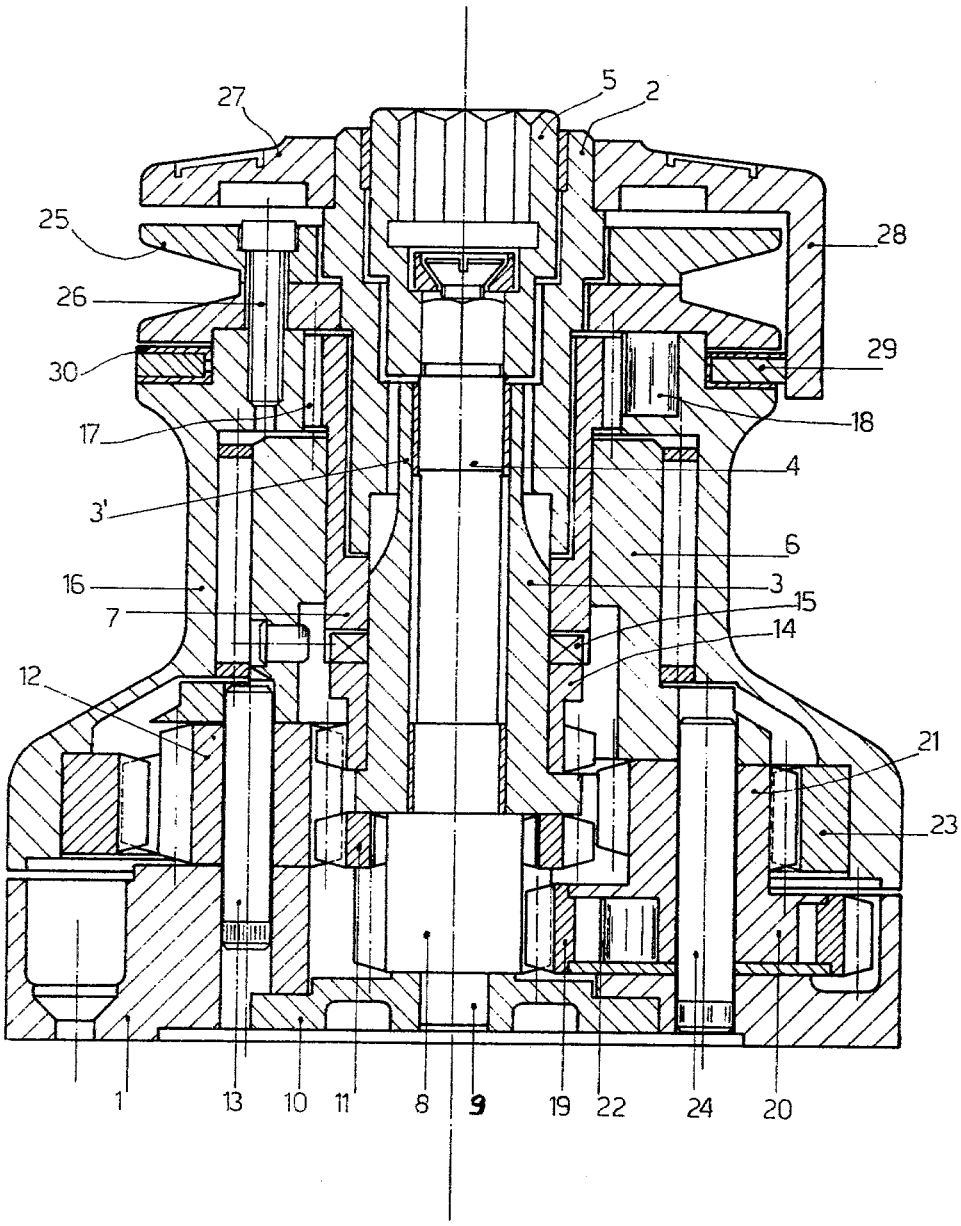
27
5
2
25
28
26
29
30
18
17
4
3'
6
16
3
15
7
14
12
21
23
1
13
10
11
8
9
19
22
24
20

TWO-SPEED WINCH

BACKGROUND OF THE INVENTION

The present invention relates to a winch, for example for nautical purpose.

More particularly the present invention concerns a two-speed winch.

Two-speed winches are well-known in the art, and usually they have a drum rotatable by means of the operation of a crank. Usually such a drum has relatively small outer dimension with respect to the arm of the crank.

The known small winches are constructed according to two different concepts. The first concept is to provide direct motion transmission between the crank and the drum 1 at a ratio of 1:1. If this is the case, it is impossible to provide such a winch with a self-tailing pulley.

The second concept is to provide a two-speed winch which has two reduced speeds relative to the rotational speed of the crank. Such a winch can be provided with a self-tailing pulley, but the winding action of such a winch is still not satisfactory with respect to the requirements made as to the speed of winding.

SUMMARY OF THE INVENTION

It is a general object of the present invention to avoid the disadvantages of the prior art winches.

More particularly, it is an object of the present invention to provide such a two-speed winch having a drum which may be driven at a ratio of 1:1 relative to the crank or at a different, for example a reduced, ratio.

Another object of the present invention resides in providing a two-speed winch having a pulley which is operable regardless of the motion-transmitting ratio on to the drum.

In pursuance of these objects and others which will become apparent hereafter, one feature of the present invention resides in providing a two-speed winch having a base, a hollow rotary drum on said base, and a direction-reversible rotary shaft on said base and extending into said drum. The rotary drum may be driven by a first motion-transmitting means for transmitting rotary motion to said drum at a first ratio (for example 1:1) in response to rotation of said shaft in one direction; or by a second motion-transmitting means for transmitting rotary motion to said drum at a different second ratio (increased or reduced relative to the second ratio) in response to rotation of the shaft in an opposite direction.

The first motion-transmitting means comprise an annular member rigidly mounted on the shaft and engaging with the crank, a sleeve rotatably mounted on the shaft and operatively connected through a first gear train with said annular member. The first gear train comprises a first gear of a predetermined diameter, which gear meshes with the annular member, a second gear of the same outer diameter as the first gear and a first pinion engaging the two gears and having an outer diameter equal to that of the shaft to thereby insure the transmission of the rotary motion to the drum from the shaft at a ratio of 1:1. The first gear train is further provided with a first free wheel operative to connect the annular member with the sleeve when the shaft rotates in one direction.

The second motion-transmitting means comprise a second gear train which includes a second pinion having an outer diameter different from that of the shaft and meshing with the drum to thereby transmit to the latter the rotary movement from said shaft at a ratio different from 1:1, for example at a reduced ratio if the outer diameter of the second pinion is smaller than that of the shaft. The second gear train is further provided with a second free wheel operative to connect the drum with said annular member when the shaft rotates in the opposite direction.

The drum is provided with a self-tailing pulley, which is operable regardless of the direction in which the shaft rotates.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE is a longitudinal sectional view of a two-speed winch embodying the present invention.

DESCRIPTION OF THE PREFERRED EMBODIMENTS

Referring now to the drawing, it may be seen that the reference numeral 1 designates a base operative to rotatably support thereon a hollow drum 16. The drum 16 is provided with a central hole operative for receiving therein a shaft 4 having a lower end portion 9 which is fixedly mounted in a plate 10 serving to close the lower opening of the drum 16. A sleeve 2 is received in the upper opening of the drum 16 and operative for receiving a crank portion 5, which is connected with the upper end of the shaft 4 and rotatable therewith. Another sleeve 3 is rotatably mounted on the shaft 4 and has an upper portion 3' which extends into the space between the outer surface of the upper end of the shaft 4 and an inner surface of the sleeve 2. This portion 3' is operative to support the upper end portion of the shaft 4. The part of the lower portion of the shaft 4 is provided with a toothing annular member 8, which has a predetermined width.

A gear 11 meshes with the annular member 8 via its inner teeth. An outer toothed portion of the gear 11 meshes with a pinion 12, which is rotatably mounted on a pin 13 which connects the base 1 with a stationary casing 6.

The pinion 12 meshes with a gear 14 which is rotatably mounted on the sleeve 3 and connected by means of a gullet tooth clutch 15 to a rotatable sleeve 7.

The outer diameter of the gear 14 is equal to that of the gear 11, so that the pinion 12 transmits the rotary motion from the shaft 4 on to the sleeve 7 at a ratio of 1:1. The sleeve 7 has an upper portion which meshes with the drum 16 via a first free wheel 17, for example of the kind having rollers 18.

The sleeve 7 rotates the drum 16 only when the shaft 4 is rotated in one direction. Thus, when the shaft 4 is rotated in said one direction the rotary motion is transmitted from this shaft to the drum at the ratio of 1:1.

The gear 8 also meshes with the gear 19 which is mounted on a second annular member 20. The annular member 20 is further provided with a second pinion 21 and a second free wheel 22. Thus, the pinion 21 is rotated only when the shaft 4 rotates in an opposite direction (that is opposite to that mentioned above). In such a case the pinion 21 meshes with an internal toothed portion 23 which is provided on the internal surface of the drum 16. The dimensions of the annular member 8, gear 19, pinion 21 and toothed portion 23 are so chosen as to considerably reduce the rotary motion of the drum 16 relative to the rotation of the shaft 4. Obviously, these dimensions may be chosen so as to increase the rotary motion on the drum 16 as compared to the rotation of the shaft 4.

The pinion 21 is rotatably mounted on a pin 24 which connects the casing 6 with the base 1.

The drum 16 is provided with a self tailing pulley 25, of a known type. The pulley 25 is rigidly mounted on the drum 16 by pins 26 (only one of which is shown in the FIGURE).

A covering plate 27 is provided around the upper end of the sleeve 2, and has an arm 28 which extends vertically besides the race of the pulley 25 and abuts at its lower portion with an annularly fixed member 29. The member 29 is accommodated in the seat defined outwardly by the outer surface of the drum 16. The outer surfaces of the member 29 are provided with a lining 30 of a harder material, so as to reduce the friction effect of the wall of the drum 16 and the member 29.

It becomes clear from the foregoing description that the winch according to the present invention is provided with a drum which may be driven at two speeds, where one speed is a 1:1 rotary motion of the shaft, and the other speed is either a reduced or an increased rotation of the drum as compared to the shaft.

In order to facilitate the winding action of the winch, the drum is provided with the self-tailing pulley which is operable regardless of the direction of rotation of the shaft.

It will be understood that each of the elements described above, or two or more together, may also find a useful application in other types of a two-speed winch differing from the types described above.

While the invention has been illustrated and described as embodied in a two-speed winch it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A two-speed winch, particularly for nautical applications, comprising a base; a hollow rotary drum located on said base; a direction-reversible rotary shaft on said base and extending into said drum; a self-tailing pulley mounted on said drum for rotation therewith and operative for facilitating the winding action of the winch; a covering plate located adjacent to said self-tailing pulley; two coaxial sleeve members surrounding said rotary shaft and located axially adjacent to one another, one of said sleeve members having an end portion rigidly mounting said covering plate of said self-tailing pulley; first motion-transmitting means for transmitting rotary motion to said drum at a first ratio of 1:1 in response to rotation of said rotary shaft in one direction, said first motion-transmitting means including a rotatable sleeve, a first driving gear train having a driving ratio 1:1 and transmitting the rotation of said rotary shaft to said rotatable sleeve, and a uni-directional gear member transmitting the rotation of said rotatable sleeve to said rotary drum in response to rotation of said rotary shaft in said one direction whereby said rotary drum rotates in a predetermined direction at a first speed; and a second motion-transmitting means for transmitting rotary motion to said rotary drum at a different second ratio in response to rotation of said rotary shaft in an opposite direction, said second motion transmitting means including a gear mounted in said rotary drum, second driving gear train driven by said rotary shaft and having a different driving ratio, and a further uni-directional drive transmitting the rotation of said second driving gear train to said gear of said rotary drum and thereby to said rotary drum in response to rotation of said rotary shaft in said opposite direction, whereby said rotary drum rotates in the same predetermined direction but at a reduced speed as compared with said first speed.

2. A two-speed winch, particularly for nautical applications, comprising a base; a hollow rotary drum on said base; a direction-reversible rotary shaft on said base and extending into said drum; first motion-transmitting means for transmitting rotary motion to said drum at a first ratio of 1:1 in response to rotation of said shaft in one direction, said first motion-transmitting means including a first annular member rigidly mounted on said shaft and rotatable therewith, a first sleeve rotatably mounted on said shaft operatively connected to said first annular member and operatively engaged with said drum to rotate the latter in response to rotation of said shaft, and a first free-wheel device operative to connect said first sleeve with said drum to transmit rotary motion to said drum in response to rotation of said shaft in said one direction; second motion-transmitting means for transmitting rotary motion to said drum at a different second ratio in response to rotation of said shaft in an opposite direction; and a self-tailing pulley mounted on said drum for rotation therewith and operative for facilitating the winding action of the winch.

3. A winch as defined in claim 2, wherein said second motion-transmitting means transmit rotary motion to said drum at a ratio reduced relative to said first ratio.

4. A winch as defined in claim 3, wherein said base is stationary.

5. A winch as defined in claim 4, further comprising means for rotating said shaft in both of said directions alternately.

6. A winch as defined in claim 5, wherein said rotating means comprise a crank having a pin portion which is inserted axially in the winch and operatively connected to said shaft to thereby rotate said shaft in response to rotating said crank.

7. A winch as defined in claim 2, wherein said first motion-transmitting means further comprise a first gear train adapted to transmit rotary motion from said first annular member to said first sleeve at a ratio of 1:1.

8. A winch as defined in claim 7, wherein said second motion transmitting means comprise a second gear train adopted to transmit rotary motion from said first annular member to said drum in response to rotation of said shaft in said opposite direction.

9. A winch as defined in claim 8, wherein said second motion-transmitting means further comprise a second free-wheel device connecting said first annular member with said second gear train when said shaft rotates in said opposite direction.

10. A winch as defined in claim 7, wherein said first gear train comprises a first gear of a predetermined outer diameter and meshing with said first annular member, a second gear fixedly mounted on said first sleeve and operatively connected to said first gear, said second gear having an outer diameter substantially equal to that of the first gear, and a first pinion having an outer surface of a diameter equal to that of the shaft and engaging said first and second gears to thereby insure a 1:1 motion-transmitting ratio from said first annular member to said first sleeve which is operatively connected to said drum.

11. A winch as defined in claim 10, wherein said second gear train comprises a second pinion engaging said drum, said second pinion having an outer diameter different from that of the shaft to thereby transmit rotary motion to said drum at a ratio different from 1:1.

12. A winch as defined in claim 11, wherein said outer diameter of the shaft exceeds that of the second pinion to thereby transmit rotary motion to said drum at a ratio which is reduced relative to said 1:1 ratio.

* * * * *